US005663116A

United States Patent [19]

Kamimura et al.

[11] Patent Number: 5,663,116

[45] Date of Patent: Sep. 2, 1997

[54] THERMAL TRANSFER DYE IMAGE-RECEIVING SHEET

[75] Inventors: Rumiko Kamimura, Munakata-gun; Hiroyuki Nemoto, Ichihara; Toshikazu Nagura, Settsu; Shigeo Hayashi, Kawasaki, all of Japan

[73] Assignee: New OJI Paper Co., Ltd., Tokyo, Japan

[21] Appl. No.: 600,426

[22] Filed: Feb. 13, 1996

[30] Foreign Application Priority Data

Feb. 15, 1995 [JP] Japan ..... 7-026860
Mar. 13, 1995 [JP] Japan ..... 7-052544

[51] Int. Cl.[6] ..... B41M 5/035; B41M 5/38

[52] U.S. Cl. ..... 503/227; 428/195; 428/218; 428/331; 428/910; 428/913; 428/914

[58] Field of Search ..... 428/195, 207, 428/218, 331, 910, 913, 914; 8/471; 503/227

[56] References Cited

U.S. PATENT DOCUMENTS 5,387,574 2/1995 Campbell et al. ..... 503/227

FOREIGN PATENT DOCUMENTS

| | | |
|---|---|---|
| 409597-A3 | 1/1991 | European Pat. Off. . |
| 522-740-A1 | 1/1993 | European Pat. Off. . |
| 630759 | 12/1994 | European Pat. Off. . |
| 62-152793 | 7/1987 | Japan . |
| WO-A-9421470 | 9/1994 | WIPO . |

*Primary Examiner*—B. Hamilton Hess
*Attorney, Agent, or Firm*—Armstrong, Westerman, Hattori, McLeland & Naughton

[57] ABSTRACT

A thermal transfer dye image-receiving sheet having a high resistance to curling and capable of smoothly travelling through a printer, and recording thereon dye images, includes a substrate sheet formed from a polyolefin resin and inorganic particles and a dye receiving resin layer formed on the substrate sheet, the substrate sheet having a longitudinal thermal shrinkage of 1.5% or less and a transversal thermal shrinkage of 0.5% upon heating from 20° C. to 120° C., and a longitudinal tensile elastic modulus of 50 MPa or less and a transversal tensile elastic modulus of 100 MPa or less at 120° C.

18 Claims, 1 Drawing Sheet

THERMAL TRANSFER DYE IMAGE-RECEIVING SHEET

BACKGROUND OF THE INVENTION

1. Field of the Invention

The present invention relates to a thermal transfer dye image-receiving sheet. More particularly, the present invention relates to a thermal transfer dye image-receiving sheet which exhibits a high resistance to curling during a printing procedure by a dye thermal transfer printer, can be smoothly fed into and delivered from the printer and can record clear dye images thereon.

2. Description of the Related Art

Currently there is an enormous interest in the development of new types of thermal transfer hard copiers, especially thermal transfer dye printers capable of printing clear full colored images or pictures. For example, thermal transfer dye printers can print full color images on a recording sheet by superposing a dye ink ribbon selected from yellow, magenta, cyan and optionally black dye ink ribbons on the recording sheet in such a manner that a dye-receiving layer of the recording sheet comes into contact with a dye ink layer of the dye ink ribbon at a location between a thermal head and a platen roll of the printer; and locally heating imagewise the dye ink ribbon by the thermal head while rotating around or reciprocating over the thermal head 3 or 4 times and while replacing the dye ink ribbons in the older of yellow, magenta, cyan and optionally black, so as to record full colored images on the recording sheet.

To thermally transfer the dye images with a high quality to the recording sheet at a high speed by the dye thermal transfer printer, the recording sheet has a dye-receiving layer formed on a substrate sheet and comprising, as a principal component, a resin having a high dyeability with sublimating-dyes.

The recording sheets may be supplied in the form of a roll or individual cut sheets. Usually, recording sheets for thermal transfer printers are supplied in the form of individual cut sheets.

To smoothly feed, print and deliver the recording sheets in the form of individual cut sheets without difficulty, the coefficient of friction of the individual cut sheets to each other, the coefficient of friction between the cut sheets and the conveyer rolls for the sheets, and the thickness, stiffness, dimensional stability and curling property of the cut sheets should be carefully controlled. Among the above-mentioned properties, the curling phenomenon of the recording sheets greatly hinders the smooth feed and delivery of the recording sheets into and from the printer. If curling of the recording sheets significantly occurs, the recording sheets are caught by a pickup roll of a sheet feeder and rolls or guides arranged in the printer, so as to result in misfeeding and jamming of the recording sheets. Also, even when the recording sheets are quite flat, sometimes a misfeed occurs, because the recording sheets are conveyed through a plurality of rollers, and thus it is preferable that the recording sheets have an appropriate curl along the curved peripheries of the rollers. Especially, when the recording sheets have a high stiffness, the stiff recording sheets are difficult to bend along the peripheries of the conveying rollers, and thus sometimes jamming occurs.

With respect to the recording sheet for the dye thermal transfer printer, it is known that a bi-axially oriented film comprising, as a principal component, a thermoplastic resin, for example, a polyolefin resin, is used as a substrate sheet.

This type of recording sheet has a dye image-receiving layer formed on the substrate sheet and comprising, as a principal component, a dye-receiving thermoplastic resin. The recording sheet having the above-mentioned substrate sheet is advantageous in that the resultant recording sheet has a uniform thickness and exhibits a high softness and a lower thermal conductivity than that of a conventional paper sheet comprising cellulose fibers, and thus the resultant printed images on the recording sheet are uniform and a high color density.

Nevertheless, the conventional recording sheet having a substrate sheet consisting of an oriented thermoplastic resin film is disadvantageous in that when dye images are thermally transferred by imagewisely heating by the thermal head, the recording sheet is thermally deformed and curled, and the curled recording sheet causes a faulty sheet delivery to occur in the printer. This disadvantage is derived from the shrinkage of the dye image-receiving layer itself, and a differential shrinkage between the dye image-receiving surface portion and the opposite surface portion of the recording sheet because the imagewise heating by the thermal head is applied to the dye image-receiving surface of the recording sheet.

To solve the above-mentioned problems of the conventional recording sheet, it has been attempted to form the substrate sheet from a plurality of films different in thermal shrinkage from each other to prevent the curling of the recording sheet. Namely, the substrate sheet is formed from a plurality of oriented films including a film having a relatively low thermal shrinkage and located in the dye image-receiving surface side of the recording sheet to which the heating at a high temperature is applied, and another film having a relatively high thermal shrinkage and located in the opposite surface side of the recording sheet which is slightly heated by the thermal head. These films are laminated on and bonded to each other so as to balance the local thermal shrinkages and prevent the curling of the recording sheet. However, the lamination of a plurality of films different in thermal shrinkage from each other to provide a substrate sheet is too complicated and costly.

Japanese Unexamined Patent publication (Kokai) No. 62-152,793 discloses a method for producing a thermal transfer image-receiving sheet having a dye-receiving layer formed on a synthetic paper substrate sheet, in which method the synthetic paper substrate sheet is heat treated at a temperature of from 60° C. to 140° C., preferably from 110° C. to 130° C. for 2 to 3 seconds or more, to prevent the curling of the image-receiving sheet during printing. Namely, the synthetic paper substrate sheet is previously heat treated to-minimize the thermal shrinkage of the image-receiving sheet during printing. In this method, the substrate sheet is continuously brought into contact with a heating roll or passed through a heating oven, to release a residual stress in the substrate sheet by heating and to decrease the, thermal shrinkage of the substrate sheet. However, if the heat treatment temperature is not high enough, the residual stress-releasing effect is insufficient. Also, if the heat treatment temperature is too high, there is a risk of elongating the substrate sheet in the longitudinal direction and of increasing the longitudinal elongation and the residual stress of the substrate sheet. Therefore, this method is not always satisfactory in controlling the curling of the image-receiving sheet to a low level and in reproducibility.

It is also known that to enhance the resistance to curling or wrinkling of the image-receiving sheet, a laminate sheet produced by bonding oriented films to both the front and back surfaces of a core sheet having a low thermal shrinkage or a high modulus of elasticity is used as a substrate sheet. However, since this type of substrate sheet is composed of a plurality of component layers different in thermal shrinkage, the resultant image-receiving sheet is sometimes curled due to a differential thermal shrinkage between the front surface portion and the back surface portion of the sheet. Namely, during the thermal transfer printing procedure, heating is applied only to the front surface of the image-receiving sheet, and thus a difference in temperature is provided between the front and back surfaces and thus the curling occurs due to the differential thermal shrinkage between the front and back surfaces.

SUMMARY OF THE INVENTION

An object of the present invention is to provide a thermal transfer dye image-receiving sheet for a dye thermal transfer printer, capable of recording clear images of dye, for example, sublimating dye, and of smoothly-travelling through the printer, without curling, wrinkling, or delivery trouble of the printed sheet.

The above-mentioned object can be attained by the thermal transfer dye image-receiving sheet of the present invention, which comprises:

a substrate sheet consisting of an oriented thermoplastic film comprising, as principal components, a polyolefin resin and an inorganic pigment, and a dye-receiving resin layer formed on a surface of the substrate sheet and comprising a resin capable receiving a thermally transferable dye for forming dye images, the substrate sheet exhibiting thermal shrinkages of 1.50% or less in the longitudinal direction and 0.50% or less in the transverse direction of the substrate sheet when heated from a temperature of 20° C. to a temperature of 120° C., and having tensile moduli of elasticity of 50.0 MPa or less in the longitudinal direction and 100.0 MPa or less in the transverse direction of the substrate sheet, determined at a temperature of 120° C.

In the thermal transfer dye image-receiving sheet of the present invention, preferably, the oriented thermoplastic film is provided with a multi-layered structure comprising a front surface layer on which the image-receiving resin layer is formed, a back surface layer and at least one core layer located between the front and back surface layers, satisfying the requirements (1) and (2):

$$Ds<Db \quad (1)$$

$$Ws>Wb, \quad (2)$$

wherein Ds represents a density of the front surface layer, Db represents a density of the back surface layer, Ws represents a thickness of the front surface layer and Wb represents a thickness of the back surface layer, and has a total thickness of 50 to 300 μm.

DESCRIPTION OF THE PREFERRED EMBODIMENT

Figure 1:
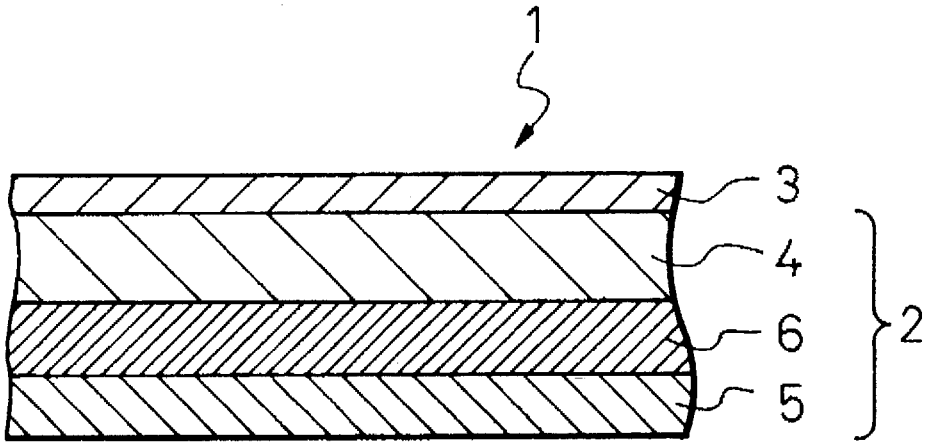
FIG. 1 is an explanatory cross-sectional profile of an embodiment of the thermal transfer dye image-receiving sheet of the present invention.

Generally, an image-receiving sheet usable for a dye thermal transfer printer comprises a substrate sheet, a dye-image-receiving layer formed on at least one surface of the substrate sheet and optionally an anti-static layer and/or a fuse adhesion-preventing layer. As a typical substrate sheet, a synthetic paper sheet, for example, an oriented thermoplastic film comprising, as principal components, a thermoplastic resin, for example, a polyolefine resin, and an inorganic pigment, and having a microporous structure. An oriented synthetic paper sheet having a microporous structure is practically used for printing, hand-writing and typing. Also, it is known that when an oriented synthetic paper sheet is used as a recording sheet for a thermal transfer printer, for example, a dye thermal transfer printer, transferred images which are clear and uniform can be formed on the sheet. However, in a thermal transfer printer, either in a sublimating dye-transferring system or a leuco dye-developing system, the image-receiving sheet is heated at one side surface thereof by a heating means such as a thermal head, and the heating at one side surface often causes the image-receiving sheet to curl.

The inventors of the present invention have made a great effort to prevent the curling of the image-receiving sheet during the thermal transfer procedure, and discovered that by controlling the thermal shrinkage and tensile modulus of elasticity at high temperature of the substrate sheet to specific ranges, the differential stress created by a difference in heating between the front and back surfaces of the image-receiving sheet can be minimized, and thus the curling of the image-receiving sheet during the thermal transfer printing procedure can be restricted and problems in sheet delivery from the printer can be prevented. The present invention has been completed on the basis of the above-mentioned discovery.

In the thermal transfer dye image-receiving sheet of the present invention, the specific substrate sheet which consists of an oriented thermoplastic film comprising, as principal components, a polyolefin resin and inorganic pigment, exhibits thermal shrinkages of 1.50% or less in the longitudinal direction and 0.5% or less in the transverse direction of the substrate sheet when heated from a temperature of 20° C. to a temperature of 120° C., and has tensile moduli of elasticity of 50.0 MPa or less in the longitudinal direction and 100.0 MPa or less in the transverse direction of the substrate sheet determined at a temperature of 120° C. enabling the resultant image-receiving sheet to be free from trouble in feeding and delivery thereof. If the thermal shrinkages are more than 1.50% in the longitudinal direction and/or more than 0.50% in the transverse direction when heated from 20° C. to 120° C., and/or the tensile moduli of elasticity are more than 50.0 MPa in the longitudinal direction and/or more than 100.0 MPa in the transverse direction, during the thermal transfer printing procedure in which an imagewise heating by the thermal head is applied to the front surface of the image-receiving sheet, a differential stress created between the front and back surface portions of the sheet increases and thus the sheet is curled.

The thermal shrinkages can be determined by the following method.

On a surface of an image-receiving sheet, two straight lines intersecting each other in the form of a cross, extending in the longitudinal and transverse directions of the sheet and having a predetermined length of 150 mm are marked at a temperature of 20° C. The marked sheet was placed in an oven, heated to a temperature of 120° C. for 10 minutes, and cooled to a temperature of 20° C. Thereafter, the lengths of the two lines are measured by using vernier calipers, and the thermal shrinkages are calculated from the differences between the original lengths and the measured lengths of the marked lines based on the original lengths.

The tensile moduli of elasticity of the sheet are determined at a temperature of 120° C. by using a tensile tester available under a trademark of TMA 8140C, from K.K. Rigaku, under a load of 5.0 g, at a frequency of 0.5 Hz and at a vibrational amplitude of 1 g.

The substrate sheet for the image-receiving sheet of the present invention consists of an oriented thermoplastic film comprising, as principal components, a polyolefin resin and an inorganic pigment.

The polyolefin resin is preferably selected from homopolymers and copolymers of ethylene, propylene and butene-1, ethylene-vinyl acetate copolymers, and poly(4-methylpentene-1). Among the above-mentioned polymers, the polypropylene resins are more preferable for the present invention, because the polypropylene resins have a high heat resistance, a high resistance to solvents and a low price.

The substrate sheet optionally comprises, in addition to the polyolefin resin, an additional resin different from the polyolefin resin, compatible with the polyolefin resin, and comprising at least one member selected from the group consisting of polystyrene, polyamide, polyethylene terephthalate, hydrolysis products of ethylene-vinyl acetate copolymers, ethylene-acrylic acid copolymers and salts thereof and vinylidene chloride copolymers, for example, vinyl chloride-vinylidene chloride copolymers.

The inorganic pigment, which is in the form of fine particles, preferably comprises at least one member selected from calcium carbonate, calcined clay, diatomaceous earth, talc, titanium dioxide, barium sulfate, aluminum sulfate and silica.

The content of the inorganic pigment in the substrate sheet (the oriented thermoplastic film) is usually 3 to 80% by weight.

The oriented thermoplastic film usable for the substrate sheet of the present invention can be produced by mixing the polyolefin resin, the inorganic pigment and optionally the additional polymeric substance which will be referred to as additional resin hereinafter, melt-extruding through a film-forming slit of an extruder and drawing monoaxially or bi-axially the extruded film to an extent that the resultant oriented thermoplastic film exhibits the specific thermal shrinkages and tensile moduli of elasticity in the longitudinal and transverse directions.

The additional resins effectively serve to adjust the thermal shrinkages and the tensile moduli of elasticity to the desired ranges. The reasons for the specific effect of the additional resins is assumed to be as follows.

Where the oriented thermoplastic film having a resinous matrix consisting of a polyolefin resin alone is heated imagewise by a thermal head, the polyolefin resin is melted and then solidified by cooling. Since the polyolefin resin has a high crystallization tendency, the solidified polyolefin resin has an increased degree of crystallization. The increase in the degree of crystallization causes the thermal shrinkages of the film resin is restricted by the presence of the additional to increase.

When the polyolefin resin is mixed with the additional resin, the crystallization of the polyolefin resin, and thus the thermal shrinkages of the resultant oriented thermoplastic film is reduced.

Also, it is possible to apply a known heat treatment to the oriented thermoplastic film to decrease the thermal thrinkages thereof and to prevent the curling of the resultant image-receiving sheet unless the heat treatment affects the effect of the present invention.

The additional resin compatible with the polyolefin resin may be selected as follows.

Where the polyolefin resin is a polypropylene resin, the additional resin is preferably selected from polyethylene resins, ethylene-propylene copolymer resins, ethylene-vinyl acetate copolymer resins, polyvinyl chloride resins, polystyrene resins, acrylonitrile-butadiene-styrene-terpolymer (ABS) resins, polyvinyl alcohol, polyacrylic ester resins, acrylonitrile-styrene copolymer resins, polyvinylidene resins acrylonitrile-styrene-acrylic ester-terpolymer (ASA or AAS) resins, acrylonitrile-ethylene-styrene terpolymer (AES) resins, cellulose derivative resins, polyurethane resins, polyvinyl butyral resins, poly-4-methylpentene-1, polybutene, polyester resins, epoxy resins, phenolic resins, urea resins, melamine resins, diallyl-phthalate resins, silicone resins, fluorine-containing polymer resins, polycarbonate resins polyamideacetal resins, polyphenyleneoxide resins, polybutylene terephthalate, polyethylene terephthalate resins, polyphenylenesulfide resins, polyimide resins, polystyrene resins, polyethersulfone resins, aromatic polyester resins, and polyallylate resins. These additional resins may be employed alone or in a mixture of two or more thereof. The additional resins are employed in an amount of 0.5 to 50% based on the weight of the polypropylene resin. The crystallization of the polypropylene resin can be restricted by blending an atactic polypropylene with an isotactic polypropylene which is different in steric regularity from the atactic polypropylene, to reduce the thermal shrinkages of the resultant substrate sheet.

Also, the addition of the additional resin effectively enables control of the density of the resultant substrate sheet.

The substrate sheet usable for the present invention preferably has a thickness of 80 to 300 μm, more preferably 120 to 250 μm. If the thickness is less than 80 μm, the resultant substrate sheet exhibits an unsatisfactory mechanical strength, and the resultant image-receiving sheet exhibits an unsatisfactory stiffness and resilience to deformation, and thus may not fully prevent the curling thereof during the thermal transfer printing procedure. Also, if the thickness is more than 300 μm, the resultant image-receiving sheet has too a large thickness. Namely, in the printer, the volume of sheet-containing space is limited and thus the larger the thickness of the individual image-receiving sheets, the smaller the number of the sheets capable of being contained in the sheet-containing space, or the larger the volume of the sheet-containing space necessary to contain a desired number of the sheets. The large sheet-containing space results in difficulty in making the thermal transfer printer compact.

The substrate sheet for the present invention may have a single layered structure, or a may consist of a composite film having a multi-layered structure and made by forming a plurality of films comprising the polyolefin resin and the inorganic pigment, laminate-bonding the films into a composite film and drawing the composite film in at least one direction. For example, the multi-layered composite film has a three layered structure comprising a front surface layer, a core layer and a back surface layer, or a four or more-layered structure. In the multi-layered structures, the component layers are different in thermal shrinkage and strain from each other and thus the strains created in the component layers during the thermal transfer printing procedure cancel each other and thus the resultant multi-layered substrate sheet enables the image-receiving sheet to exhibit an enhanced resistance to curling.

Also, in the multi-layered structure having the front surface layer, at least one core layer and the back surface layer, when at least the core layer comprises the blend of the polyolefin resin and the additional resin compatible with the polyolefin resin, the resultant substrate sheet can exhibit well-balanced thermal shrinkages and tensile moduli of elasticity.

In the image-receiving sheet of the present invention, the dye-receiving resin layer formed on a surface of the substrate sheet comprises, as a principal component, a resin capable of receiving a dye thermally transferred from a dye ink ribbon. The dye-receiving resin comprises at least one member selected from thermoplastic saturated polyester resins, vinyl chloride-vinyl acetate copolymer resins, vinyl chloride-vinyl propionate polymer resins, polycarbonate resins, polyvinyl acetal resins, polyacrylic acid ester resins, cellulose derivatives, actinic radiation-cured resins, and other dyeable synthetic resins.

The dye-receiving resin layer preferably has a thickness of 1 to 12 μm, more preferably 2 to 7 μm. If the thickness is less than 1 μm, the resultant dye-receiving resin layer exhibits an unsatisfactory dye-receiving sensitivity and gloss, and the resultant dye images exhibit a low color density. Also, if the thickness is more than 12 μm, not only, the dye-receiving capacity is saturated, thus causing an economical disadvantage, but also, the resultant dye images have a reduced color density.

In the dye-receiving resin layer of the image-receiving sheet of the present invention, an additive, for example, cross-linking agent for the dye-receiving resin, lubricating agent, and releasing agent for the purpose of preventing an undesired adhesion of the dye ink ribbon with the image-receiving sheet due to the heating by the thermal head during the thermal transfer printing procedure, is optionally contained. Also, if necessary, a further additive, for example, antioxidant, white pigment, coloring material, brightening agent, ultraviolet ray-absorber and sensitizing agent, may be added to the dye-receiving layer.

The further additive may comprise, for example, substituted phenol compounds or terpene, which are low molecular weight compounds. The white pigment, coloring material (blue or violet coloring pigment and dye) and brightening agent (fluorescent brightener) can be employed to enhance the whiteness and opaqueness of the dye-receiving resin layer, to adjust the color of the dye-receiving resin layer to a desired color and to control the brightness of the dye-receiving resin layer to a desired level. The additive or further additive, for example, the white pigment, ultraviolet ray-absorber and cross-linking agent, may be contained in the dye-receiving resin layer by mixing these agents with the dye-receiving resin, and coating the mixture on the front surface of the substrate sheet. Alternatively, the additive or further additive may be coated, as uppercoat or undercoat, on or under the dye-receiving resin layer.

The pigment included in the dye-receiving layer comprises preferably silica, more preferably specific silica having an average particle size of 1 to 12 μm and a specific surface area of 30 to 250 $m^2/g$. The pigment is contained preferably in an amount of 5 to 20%, by weight based on the weight of the dye-receiving resin. If the average size of the silica particles is too large, so that portions of the silica particles project from the front surface of the dye-receiving resin layer, the projected portions cannot be colored with dye and thus non-dye-transferred defective portions are formed in the thermally transferred images. Therefore, the pigment particles preferably have a size smaller than the thickness of the dye-receiving resin layer. When silica is added to the dye-receiving resin layer formed on the substrate sheet, the silica effectively prevents undesired adhesion of the dye ink ribbon with the image-receiving sheet, adequately controls a friction between the dye ink ribbon and the image-receiving sheet, and prevents wrinkles formed on the dye ink ribbon from being transferred to the dye-receiving resin layer and the transferred images from becoming defective. Also, the silica effectively improves the conveyance of the image-receiving sheets through the printer, and enhances the clearness of the resultant dye images on the dye-receiving layer.

Further, to enhance the resistance of the dye-receiving layer to fuse-adhesion with the dye ink ribbon during the thermal transfer printing procedure, the dye-receiving layer preferably contains a release agent. The release agent is preferably selected from waxes, for example, paraffin and polyethylene wax, metal soaps, silicone oils, silicone resins, fluorine-containing surfactants and fluorine-containing resins. Usually, the release agent is added in an amount of 15% by weight or less to the dye-receiving resin layer.

Furthermore, an intermediate layer is optionally arranged between the substrate sheet, for example, the oriented thermoplastic resin substrate sheet, and the dye-receiving resin layer to enhance the adhesion therebetween. The intermediate layer may comprise a hydrophilic or hydrophobic binder resin. Namely, the binder resin for the intermediate layer is selected from, for example, vinyl polymers, for example, polyvinyl alcohol and polyvinyl pyrrolidone, vinyl polymer derivatives, polyacrylic polymers, for example, polyacrylamide, polydimethylacrylamide, polyacrylic acid and salts thereof and polyacrylic acid esters, polymethacrylic polymers, for example, polymethacrylic acid and polymethacrylic acid esters, and natural polymers and derivatives thereof, for example, starch, sodium alginate, gum arabic, casein and carboxy-methyl cellulose.

Still furthermore, to prevent the generation of static electricity on the image-receiving sheets and to enable the sheets to smoothly travel through the printer, an antistatic agent is contained in at least one of the component layers of the image-receiving sheet or coated on the front surface of the dye-receiving resin layer or the back surface of the substrate sheet. The antistatic agent preferably contains a cationic hydrophilic polymer, for example, quaternary ammonium group-containing polymers, polyamine derivatives, polyethylene imine, cationic monomer-acrylic monomer copolymers, cation-modified acrylic amides, and cation-modified starch.

The dye-receiving resin layer or another additional layer may be formed by coating a coating liquid or paste by using a coater, for example, a bar coater, gravure coater, comma coater, or air knife coater, and drying the coated layer, in conventional manner.

In an embodiment of the dye image-receiving sheet of the present invention, the oriented thermoplastic film for the substrate sheet is provided with a multi-layered structure comprising a front surface layer on which the dye-receiving resin layer is formed, a back surface layer and at least one core layer located between the front and back surface layers; and satisfying the requirements (1) and (2):

$$Ds<Db \quad (1)$$

$$Ws>Wb, \quad (2)$$

wherein Ds represents a density of the front surface layer, Db represents a density of the back surface layer, Ws represents a thickness of the front surface layer and Wb represents a thickness of the back surface layer. Also, the oriented thermoplastic film has a total thickness of 50 to 300 μm.

In the embodiment of the dye image-receiving sheet of the present invention, the oriented thermoplastic film for the substrate sheet has a three or more-layered structure.

For example, referring to FIG. 1, a thermal transfer dye image-receiving sheet 1 comprises a substrate sheet 2 and a dye-receiving resin layer 3 formed on a front surface of the substrate sheet 2.

The substrate sheet 2 consists of a three-layered composite film composed of a front surface layer 4 on which the dye-receiving resin layer 3 is arranged, a back surface layer 5 and a core layer 6 arranged between the front and back surface layers 4 and 5. Each of the front surface, core and back surface layers 4, 6 and 5 consists of a single layered film layer. Of course, the substrate sheet of the present invention may consist of a four or more-layered composite film.

The multi-layered substrate sheet usable for the present invention has a thickness of 50 to 300 μm, more preferably 120 to 250 μm. If the thickness is less than 50 μm, the resultant substrate sheet may exhibit an unsatisfactory mechanical strength and thus have a high risk of problems in the conveyance of the image-receiving sheets through the printer. Also, if the thickness is more than 300 μm; the resultant image receiving sheets may have too a large thickness, thus the number of the image-receiving sheets capable of being contained in the sheet-containing space of the printer may become too small, and it may become difficult to provide a compact printer.

In the multi-layered substrate sheet, the thickness Ws of the front surface layer and the thickness Wb of the back surface layer satisfies the relationship (2):

$$Ws>Wb. \quad (2)$$

The thicknesses Ws and Wb of the front and back surface layers are not limited to specific ranges. Nevertheless, the front surface layer thickness Ws is preferably 20 to 120 μm, and the back surface layer thickness Wb is 15 to 100 μm. If Ws is not more than Wb, the resultant substrate sheet may not fully prevent the curling of the image-receiving sheet during the thermal transfer printing procedure. If the thickness Ws of the front surface layer is less than 20 μm, the front surface of the resultant substrate sheet may be uneven and clearness of the dye images received thereon may be unsatisfactory. If the thickness Ws of the front surface layer is more than 120 μm, the resultant substrate sheet may be too stiff. The thickness of the core layer is preferably 15 to 80 μm.

In the multi-layered substrate sheet, when the density Ds of the front surface layer and the density Db of the front surface layer meet with the requirement (1):

$$Ds<Db, \quad (1)$$

it is found that the resultant image-receiving sheet exhibits a high resistance to curling in the thermal transfer printing procedure, and the dye images printed thereon are very clear. Preferably, a ratio Ds/Db is in the range of from 0.3 to 0.95, more preferably 0.6 to 0.9. In the present invention, there are specific limitations to the densities Ds and Db. Nevertheless, the front surface layer density (Ds) is preferably 0.5 to 1.2 g/cm$^3$, more preferably 0.7 to 1.2 g/cm$^3$, and the back surface layer density (Db) is preferably 0.8 to 1.5 g/cm$^3$, more preferably 0.8 to 1.3 g/cm$^3$. The densities of the front and back surface layers can be determined by preparing single-layered films corresponding to the front and back surface layers under the same film-forming conditions as those of the multi-layered film-forming conditions, measuring areas and weights of the films and calculating the densities from the measured areas and weights.

If Ds is not less than Db, the thermal shrinkage of the front surface layer may be higher than that of the back surface layer, and thus the resultant image-receiving sheets may be curled during the thermal transfer printing procedure.

In polyolefin resin films having the same composition as each other, an increase in the drawing ratio results in an increase in the degree of crystallization, in an increase in the density and thus in an increase in the thermal shrinkage of the drawn films. Accordingly, in the preparation of the multi-layered film, the densities of the front and back surface layers can be controlled by melt-laminating the front and back surface layers on both the front and back surfaces of a core layer while controlling the thicknesses of the front and back surface layers and optionally controlling the draw ratios of the front and back surface layers, cooling the resultant laminated composite film, re-heating the cooled composite film, and drawing the re-heated composite film in a direction at a right angle to the direction of monoaxial drawing applied to the core layer at a desired draw ratio.

The reasons why the curling of the resultant image-receiving sheet during the thermal transfer printing procedure can be restricted by adjusting the densities Ds and Db of the front and back surface layers so as to meet the requirement (1): Ds<Db, is not yet completely clear. However, it is assumed that in the thermal transfer printing procedure, the image-receiving sheet is interposed, pressed and heated between a thermal head and a platen roller. In this printing procedure, the oriented film thermally shrinks due to a residual stress. Also, since the heating is applied asymmetrically to the front and back surfaces of the image-receiving sheet, a differential stress is created between the front and back surface layers of the multi-layered substrate sheet. The differential stress causes the image-receiving sheet to curl during the thermal transfer printing procedure.

In the present invention, the front surface layer of the substrate sheet, on which the dye-receiving resin layer is formed, has a lower thermal shrinkage than that of the back surface layer, so that the curling of the image-receiving sheet during the thermal transfer printing procedure can be effectively restricted.

In an embodiment of the present invention, the oriented-thermoplastic film for the substrate sheet is, for example, a multi-layered, oriented thermoplastic resin film comprising a front surface layer comprising a polyolefin resin film containing 0 to 25% by weight of fine inorganic particles, a core layer comprising a polyolefin resin film containing fine inorganic particles in an amount more than that in the front surface layer and having a number of microvoids formed by drawing, and a back surface layer comprising a monoaxially oriented polyolefin resin film containing 10 to 75% by weight of fine inorganic particles.

The polyolefin resin for the front and back surface and core layers is preferably selected from polyethylene resins, polypropylene resins, ethylene-propylene copolymer resins, ethylene-vinyl acetate copolymer resins and poly(4-methylpentene-1) resins, more preferably polypropylene resins which have a high heat resistance, a high resistance to solvents and a low price. As mentioned above, the polyolefin resin is optionally blended with an additional resin, for example, polystyrene, polyamide, polyethylene terephthalate, partial hydrolysis product of ethylene-vinyl acetate copolymer, ethylene-acrylic acid copolymer and salt thereof or vinylidene chloride copolymer, for example, vinylidene chloride-vinyl chloride copolymer. Also, the inorganic particles may be selected from fine calcium carbonate, calcined clay, diatomaceous earth, talc, titanium dioxide, barium sulfate, aluminum sulfate and silica particles.

In the thermal transfer dye image-receiving sheet of the present invention, the oriented thermoplastic film for the substrate sheet can be produced by coating a polyolefin resin melt on a surface of a core polyolefin resin film drawn in one direction and further coating a polyolefin resin melt on the opposite surface of the core polyolefin resin film, by a melt-laminating method; cooling the resultant three-layered film to room temperature; heating the cooled film at a temperature of 100° to 180° C.; drawing the heated film in a direction at a right angle to the drawing direction of the core polyolefin resin film; and heat treating the drawn film at a temperature of 50° to 120° C.

As mentioned above, the multi-layered, oriented polyolefin resin film for the substrate sheet comprises at least the front surface layer, core layer and back surface layer.

In another embodiment of a process for producing the multi-layered, oriented polyolefin resin film, a polyolefin resin layer is melt-laminated on a front surface of a monoaxially oriented polyolefin resin film for the core layer to form a front surface layer; another polyolefin resin layer containing 10 to 75% by weight of fine inorganic particles is melt-laminated on the back surface of the core layer to form a back surface layer; the resultant laminate sheet is cooled; the cooled sheet is re-heated and drawn in a direction at a right angle to the monoaxial drawing direction of the core layer; and then the drawn sheet is heat-treated.

In the above-mentioned process, the core layer is biaxially drawn and a great number of microvoids are formed in the core layer. The front and back surface layers comprise monoaxially oriented films having finely roughened surfaces. The finely roughened surfaces preferably have a Bekk smoothness of 500 to 15,000 seconds.

To obtain an image-receiving sheet having a high resistance to curling, it is important that the thermal shrinkages of the front and back surface layers be well balanced with each other. It possible that a resin component consisting of a polyolefin resin alone is used to form the back surface layer and a resin blend of the polyolefin resin with an additional resin is used to form the front surface layer. For example, a polypropylene resin is used to form the back surface layer, and a resin blend comprising a polypropylene resin, an ethylene-propylene copolymer resin and an ethylene-propylene-diene copolymer rubber is employed to form the front surface layer. The blended additional resin effectively restricts the recrystallization of the polyolefin resin in the front surface layer so as to control the thermal shrinkage of the front surface layer so that it properly balances the thermal shrinkage of the back surface layer.

EXAMPLES

The present invention will be further illustrated with reference to the following examples which are merely representative and do not restrict the scope of the present invention in any way.

In the examples, the resultant thermal transfer dye image-receiving sheets were subjected to the following tests.

(1) Travelling performance through a printer

The image-receiving sheets were heated at a temperature of 50° C. for 48 hours and cut into A4 size.

The cut sheets were subjected in the number of 20 sheets to a continuous thermal transfer printing using a sublimating dye printer available under the trademark of Video Printer JX 7000, from Sharp K.K. The travelling performance of the image-receiving sheets was evaluated and categorized in the following classes.

| Class | Evaluation |
|---|---|
| 2 | No trouble occurred |
| 1 | Trouble occurred |

(2) Resistance to curling

After the above-mentioned continuous printing procedure, the last (twentieth) printed sheet was placed on a horizontal plane so that the printed surface faced upward and the corners of the sheet were allowed to raise from the horizontal plane. The heights of the corner ends from the horizontal plane were measured. When the sheet curled into a cylinder form, the diameter of the cylinder was measured.

When the measured curling value was less than 11 mm, the sheets were evaluated as very good in travelling performance through the printer and appearance thereof.

When the measured curling value was 11 mm or more but less than 26 mm, the sheets were evaluated as useful without difficulty for the thermal transfer printing. When the measured curling value was 26 mm or more, or the sheet was curled into a cylinder, the sheets were evaluated as practically useless, because the curled sheets are difficult to smoothly travel through and deliver from the printer.

(3) Clearness of the received dye images

The dye images received on the dye-receiving layer were observed by naked eye to evaluate the quality of the dye images and categorized in the following classes.

| Class | Evaluation |
|---|---|
| 3 | Very clear and sharp |
| 2 | Usable for practical use |
| 1 | Unclear and useless for practical use |

Example 1

A mixture of 50 parts by weight of a polypropylene resin with 20 parts by weight of a polyethylene resin and 30 parts by weight of fine calcium carbonate particles having an average particle size of 1.5 μm was mix-kneaded in an extruder at a temperature of 27° C. and then melt-extended into a film form, and the extended film was cooled to form an undrawn sheet. The undrawn sheet was heated to a temperature of 140° C., drawn at a draw ratio of 5.0 in the longitudinal direction and at a draw ratio of 3.0 in the transverse direction, to provide an oriented sheet having a thickness of 180 μm. The oriented sheet was heat-treated at a temperature of 90° C. for 24 hours to control the thermal shrinkage of the sheet to a desired level.

The resultant oriented sheet exhibited a longitudinal thermal shrinkage of 1.00%, and a transverse thermal shrinkage of 0.06% when the heating temperature was raised from 20° C. to 120° C., and a longitudinal tensile modulus of elasticity of 17.2 MPa and a transverse tensile modulus of elasticity of 55.8 MPa at a temperature of 120° C.

The oriented sheet was employed as a substrate sheet.

A coating liquid (1) having the composition shown below was coated on a front surface of the substrate sheet and dried to form a dye-receiving resin layer having a dry thickness of 5 m.

Coating liquid (1)

| Compound | Part by weight |
|---|---|
| Saturated polyester resin (*)1 | 100 |
| Silicone oil (*)2 | 25 |
| Polyisocyanate compound (*)3 | 5 |
| Silica (*)4 | 15 |

Note
(*)1 . . . Trademark: Vylon 200, made by Toyobo K. K.
(*)2 . . . Trademark: SH 3740 (release agent), made by Toray Dow-Corning Silicone K. K.
(*)3 . . . Trademark: Coronate L (Cross-linking agent), made by Nihon Polyurethane Kogyo K. K.
(*)4 . . . Trademark: C212, made by Mizusawa Kagaku Kogyo K. K.
Average particle size: 2.2 μm
Specific surface area: 170 $m^2/g$ The mixture was dissolved and dispersed in a solvent consisting of toluene and methylethylketone in a mixing ratio of 5/1 to form a 15% coating liquid. The thermal shrinkages and the tensile moduli of elasticity were determined by the above-mentioned measurement methods.

The test results are shown in Table 1.

Example 2

A thermal transfer dye image-receiving sheet was produced and tested by the same procedures as in Example 1, with the following exceptions.

The substrate sheet was produced by melt-kneading a mixture of 50 parts by weight of a polypropylene with 30 parts by weight of an ethylene-propylene copolymer resin and 20 parts by weight of calcium carbonate particles having an average size of 1.5 μm in a melt-extruder at a temperature of 270° C.; the melt-kneaded resin mixture was extruded in a sheet form from the extruder; the extruded sheet was cooled by a cooling device to provide an undrawn sheet. The undrawn sheet was then heated to a temperature of 140° C., and biaxially drawn at a longitudinal draw ratio of 5.0 and at a transverse draw ratio of 7.0, to provide an oriented sheet having a thickness of 185 μm.

The resultant oriented substrate sheet exhibited a longitudinal thermal shrinkage of 1.24% and a transverse thermal shrinkage of 0.33% when heated from 20° C. to 120° C., and a longitudinal tensile modulus of elasticity of 27.5 MPa and a transverse tensile modulus of elasticity of 48.1 MPa at a temperature of 120° C.

The test results are shown in Table 1.

Example 3

A thermal transfer dye image-receiving sheet was produced and tested by the same procedures as in Example 2, with the following exceptions.

In the preparation of the substrate sheet, the resin mixture consisted of 70 parts by weight of the polypropylene resin, 10 parts by weight of the polyethylene, and 20 parts by weight of the calcium carbonate particles having the average size of 1.5 μm.

The resultant oriented substrate sheet having the thickness of 185 μm had a longitudinal thermal shrinkage of 1.45%, and a transverse thermal shrinkage of 0.46% when heated from 20° C. to 120° C., and a longitudinal tensile modulus of elasticity of 45.5 MPa and a transverse tensile modulus of elasticity of 98.8 MPa at a temperature of 120° C.

The test results are shown in Table 1.

Example 4

A thermal transfer dye image-receiving sheet was produced and tested by the same procedures as in Example 1, with the following exceptions.

① Preparation of undrawn sheets (A) for front and back surface layers

A mixture of 70 parts by weight of a polypropylene resin with 10 parts by weight of a polyethylene resin and 20 parts by weight of calcium carbonate particles having an average size of 1.5 μm was melt-kneaded in a melt extruder at a temperature of 270° C., extruded in the form of a sheet from the extruder and cooled by a cooling device to provide two undrawn sheets (A) for the front and back surface layers.

② Preparation of oriented sheet (B) for core layer

A mixture of 55 parts by weight of a polypropylene resin with 10 parts by weight of a polyethylene resin, 10 parts by weight of an ethylene-propylene copolymer resins and 25 parts by weight of calcium carbide particles having an average size of 1.5 μm was melt-kneated in a melt-extruder at a temperature of 270° C.; the melt was extruded into the form of a sheet from the extruder and then cooled by a cooling device to provide an undrawn sheet. This undrawn sheet was heated to a temperature of 140° C. and at this temperature, the sheet was drawn at a draw ratio of 5.0 in the longitudinal direction of the sheet to provide an oriented sheet (B) for the core layer.

③ Preparation of a three layered laminate sheet

The two undrawn sheets (A) were laminated on the front and back surfaces of the oriented sheet (B) and the laminate was drawn at a draw ratio of 6.0 in the transverse direction of the core layer sheet (B) at a temperature of 170° C.

The resultant three layered sheet had a total thickness of 170 μm and was composed of a front surface layer having a thickness of 60 μm, a core layer having a thickness of 50 μm and a back surface layer having a thickness of 60 μm.

Also, the three layered sheet exhibited a longitudinal thermal shrinkage of 0.94% and a transverse thermal shrinkage of 0.08% upon heating from 20° C. to 120° C., and a longitudinal tensile modulus of elasticity of 9.5 MPa and a transverse tensile modulus of elasticity of 70.6 MP at a temperature of 120° C.

The three-layered sheet was employed as a substrate sheet.

The test results are shown in Table 1.

Comparative Example 1

A thermal transfer dye image-receiving sheet was produced and tested by the same procedures as in Example 1, with the following exceptions.

The substrate sheet consisted of a biaxially oriented thermoplastic resin sheet having a thickness of 110 μm and produced in such a manner that a mixture of 70 parts by weight of a polypropylene resin with 30 parts by weight of calcium carbonate particles having an average size of 1.5 μm was melt-kneaded in a melt-extruder at a temperature of 270° C.; the melt was extruded into a sheet form and cooled by a cooling device to provide an undrawn sheet; the undrawn sheet was heated to a temperature of 140° C. and biaxially drawn at a draw ratio of 5.0 in the longitudinal direction and at a draw ratio of 5.0 in the transverse direction, to provide an oriented substrate sheet.

The resultant substrate sheet exhibited a longitudinal thermal shrinkage of 2.2% and a transverse thermal shrinkage of 0.76% upon heating from 20° C. to 120° C. and a longitudinal tensile modulus of elasticity of 26.7 MPa and a transverse tensile modulus of elasticity of 108.0 MPa at a temperature of 120° C.

The test results are shown in Table 1.

Comparative Example 2

A thermal transfer dye image-receiving sheet was produced and tested by the same procedures as in Example 1, with the following exceptions.

The substrate sheet consisted of a biaxially oriented thermoplastic resin sheet having a thickness of 150 μm and produced in such a manner that a mixture of 80 parts by weight of a polypropylene resin with 20 parts by weight of calcium carbonate particles having an average size of 1.5 μm was melt-kneaded in a melt-extruder at a temperature of 270° C.; the melt was extruded into a sheet form and cooled by a cooling device to provide an undrawn sheet; the undrawn sheet was heated to a temperature of 140° C. and biaxially drawn at a draw ratio of 5.0 in the longitudinal direction and at a draw ratio of 7.0 in the transverse direction, to provide an oriented substrate sheet.

The resultant substrate sheet exhibited a longitudinal thermal shrinkage of 2.66% and a transverse thermal shrinkage of 1.02% upon heating from 20° C. to 120° C., and a longitudinal tensile modulus of elasticity of 57.1 MPa and a transverse tensile modulus of elasticity of 87.4 MPa at a temperature of 120° C.

The test results are shown in Table 1.

Comparative Example 3

A thermal transfer dye image-receiving sheet was produced and tested by the same procedures as in Example 1, with the following exceptions.

The substrate sheet consisted of a biaxially oriented thermoplastic resin sheet having a thickness of 190 μm and produced from a mixture of 60 parts by weight of a polypropylene resin with 40 parts by weight of calcium carbonate particles having an average size of 1.5 μm by the same procedures as in Example 1.

The resultant substrate sheet exhibited a longitudinal thermal shrinkage of 1.48% and a transverse thermal shrinkage of 0.40% upon heating from 20° C. to 120° C., and a longitudinal tensile modulus of elasticity of 63.7 MPa and a transverse tensile modulus of elasticity of 121.0 MPa at a temperature of 120° C.

The test results are shown in Table 1.

① Preparation of monoaxially oriented sheet (M1) for core layer

A mixture of 85 parts by weight of a polypropylene resin with 5 parts by weight of a polyethylene resin and 15 parts by weight of calcium carbonate particles having an average size of 1.5 μm was melt-kneaded in a melt-extruder at a temperature of 270° C., and then extruded into a sheet form through an extruding slit of the extruder; and the resultant undrawn sheet was drawn at a draw ratio of 5.0 in the longitudinal direction of the sheet to provide a monoaxially oriented sheet (M1) for a core layer three-layered substrate sheet.

② Preparation of three-layered substrate sheet

A mixture of 55 parts by weight of a polypropylene resin with 30 parts by weight of a polyethylene resin and 15 parts by weight of calcium carbonate particles having an average size of 1.5 μm was melt-kneaded in a melt-extruder at a temperature of 270° C.; the melt was extruded in a sheet form from the extruder; and the extruded sheet (S1) was laminated on the front surface of the monoaxially oriented sheet (M1). Also, a mixture of 55 parts by weight of a polypropylene resin with 45 parts by weight of calcium carbonate particles having an average size of 1.5 μm was melt-kneaded in a melt-extruder at a temperature of 270° C. and extruded in a sheet form from the extruder; and the extruded sheet (B1) was laminated on the back surface of the monoaxially oriented sheet (M1). The resultant three-layered sheet was drawn at a draw ratio of the transverse direction of the monoaxially oriented sheet (M1) at a temperature of 160° C.

The resultant oriented substrate sheet had a total thickness of 150 μm and consisted of a monoaxially oriented front surface layer having a thickness of 60 μm, a biaxially oriented core layer having a thickness of 40 μm and a monoaxially oriented back surface layer having a thickness of 50 μm.

The front surface had a density of 0.9 g/cm$^3$ and the back surface layer had a density of 1.2 g/cm$^3$.

TABLE 1

| Example No. | | Thermal shrinkage (%) Longitudinal | Thermal shrinkage (%) Transverse | Tensile modulus of elasticity (MPa) Longitudinal | Tensile modulus of elasticity (MPa) Transverse | Curling (mm) | Travelling property in printer | Clearness of dye images |
|---|---|---|---|---|---|---|---|---|
| Example | 1 | 1.00 | 0.06 | 17.1 | 55.8 | 14 | 2 | 3 |
| | 2 | 1.24 | 0.33 | 27.5 | 48.1 | 16 | 2 | 3 |
| | 3 | 1.45 | 0.46 | 45.5 | 98.8 | 20 | 2 | 3 |
| | 4 | 0.94 | 0.08 | 9.5 | 70.6 | 9 | 2 | 3 |
| Comparative | 1 | 2.20 | 0.76 | 26.7 | 108.6 | 35 | 1 | 2 |
| Example | 2 | 2.66 | 1.02 | 57.1 | 87.4 | (*)129 | 1 | 2 |
| | 3 | 1.48 | 0.40 | 63.7 | 121.0 | 38 | 1 | 2 |

Note: (*)1 . . . This sheet curled into a cylinder form having a diameter of 29 mm.

Table 1 clearly shows that the thermal transfer dye image-receiving sheets of Examples 1 to 4 in accordance with the present invention exhibited a high resistance to curling, a good travelling property in the printer and could record thereon clear dye images.

However, the comparative image-receiving sheets of Comparative Examples 1 to 3 significantly curled and often blocked the printer during the thermal transfer printing procedure.

Example 5

A thermal transfer dye image-receiving sheet was produced by the following procedures.

Also, the resultant oriented substrate sheet exhibited a longitudinal thermal shrinkage of 0.94% and a transverse thermal shrinkage of 0.12% upon heating from 20° C. to 120° C. and a longitudinal tensile modulus of elasticity of 19.6 MPa and a transverse tensile modulus of elasticity of 68.5 MPa at a temperature of 120° C.

③ Production of thermal transfer dye image-receiving sheet

A coating liquid (2) for a dye-receiving resin layer was prepared in the following composition.

| Component | Part by weight |
|---|---|
| Polyester resin (*)5 | 100 |
| Silicone oil (*)6 | 3 |
| Polyisocyanate component (*)7 | 5 |
| Toluene | 300 |

Note:
(*)5 . . . Trademark: Vylon 200, made by Toyobo K.K.
(*)6 . . . Trademark: KF 393 (release agent), made by Shinetsu Silicone K.K.)
(*)7 . . . Trademark: Takenate (cross-linking agent), made by Takeda Yakuhin K.K.

The coating liquid (2) was coated on the front surface of the substrate sheet and dried to form a dye-receiving resin sheet having a dry thickness of 5 μm.

The test results are shown in Table 2.

Example 6

A thermal transfer dye image-receiving sheet was produced and tested by the same procedures as in Example 5, with the following exceptions.

In the preparation of the monoaxially oriented sheet for the core layer, the width of the extruding slit of the melt-extruder was adjusted so as to provide a monoaxially oriented sheet (M2).

In the preparation of the three-layered substrate sheet, a mixture of 75 parts by weight of a polypropylene resin with 5 parts by weight of a polyethylene resin and 20 parts by weight of a polyethylene resin and 15 parts by weight of calcium carbonate particles having an average size of 1.5 μm was melt-kneaded in a melt-extruder at a temperature of 270° C.; the melt was extruded into a sheet form from the extruder; and the extruded sheet (B2) was laminated on the back surface of the monoaxially oriented sheet (M2); and the resultant laminate was drawn at a draw ratio of 3.5 in the transverse direction at a temperature of 160° C. Also, a mixture of 50 parts by weight of a polypropylene resin with 25 parts by weight of a polyethylene resin and 25 parts by weight of calcium carbonate particles having an average size of 1.5 μm was melt-kneaded in a melt-extruder at a temperature of 270° C. and extruded into a sheet form from the extruder; and the extruded sheet (S2) was laminated on the front surface of the monoaxially oriented sheet (M2).

The resultant three-layered sheet was drawn at a draw ratio of 3.0 in the transverse direction at a temperature of 160° C.

The resultant oriented substrate sheet had a total thickness of 250 μm and consisted of a monoaxially oriented front surface layer having a thickness of 100 μm, a biaxially oriented core layer having a thickness of 80 μm and a monoaxially oriented back surface layer having a thickness of 70 μm.

The front surface layer had a density of 1.0 g/cm$^3$ and the back surface layer had a density of 1.1 g/cm$^3$.

Also, the resultant oriented substrate sheet exhibited a longitudinal thermal shrinkage of 1.12% and a transverse thermal shrinkage of 0.35% upon heating from 20° C. to 120° C., and a longitudinal tensile modulus of elasticity of 24.8 MPa and a transverse tensile modulus of elasticity of 8.21 MPa at a temperature of 120° C.

The coating liquid (2) for a dye-receiving resin layer was coated on the front surface of the three layered, oriented substrate sheet in the same manner as in Example 1.

The test results are shown in Table 2.

Example 7

A thermal transfer dye image-receiving sheet was produced and tested by the same procedures as in Example 5, with the following exceptions.

① Preparation of monoaxially oriented sheet (M3) for core layer

A mixture of 70 parts by weight of a polypropylene resin with 10 parts by weight of a polyethylene resin, and 20 parts by weight of calcium carbonate particles having an average size of 1.5 μm was melt-kneaded in a melt-extruder at a temperature of 270° C., and then extruded into a sheet form through an extruding slit of the extruder; and the resultant undrawn sheet was drawn at a draw ratio of 5.0 in the longitudinal direction of the sheet to provide a monoaxially oriented sheet (M3) for a core layer of a three-layered substrate sheet.

② Preparation of three-layered substrate sheet

A mixture of 50 parts by weight of a polypropylene resin with 20 parts by weight of a polyethylene resin, 20 parts by weight of a polystyrene resin and 10 parts by weight of calcium carbonate particles having an average size of 1.5 μm was melt-kneaded in a melt-extruder at a temperature of 270° C.; the melt was extruded in a sheet form from the extruder; and the extruded sheet (S3) was laminated on the front surface of the monoaxially oriented sheet (M3). Also, a mixture of 70 parts by weight of a polypropylene resin with 10 parts by weight of a polyethylene resin, 10 parts by weight of a polystyrene resin and 10 parts by weight of calcium carbonate particles having an average size of 1.5 μm was melt-kneaded in another melt-extruder at a temperature of 270° C. and extruded in a sheet form from the extruder; and the extruded sheet (B3) was laminated on the back surface of the monoaxially oriented sheet (M1).

The resultant three-layered sheet was drawn at a draw ratio of 6.0 in the transverse direction of the monoaxially oriented sheet (M3).

The resultant oriented substrate sheet had a total thickness of 80 μm and consisted of a monoaxially oriented front surface layer having a thickness of 30 μm, a biaxially oriented core layer having a thickness of 30 μm and a monoaxially oriented back surface layer having a thickness of 20 μm.

The front surface layer had a density of 0.9 g/cm$^3$ and the back surface layer had a density of 1.0 g/cm$^3$.

Also, the resultant oriented substrate sheet exhibited a longitudinal thermal shrinkage of 1.732% and a transverse thermal shrinkage of 0.46% upon heating from 20° C. to 120° C., and a longitudinal tensile modulus of elasticity of 11.3 MPa and a transverse tensile modulus of elasticity of 85.9 MPa at a temperature of 120° C.

③ Production of thermal transfer dye image-receiving sheet

The same coating liquid (2) as in Example 5 was coated on the front surface of the substrate sheet and dried in the same manner as in Example 5.

Comparative Example 4

A thermal transfer dye image-receiving sheet was produced and tested by the same procedures as in Example 5, with the following exceptions.

A single-layered substrate sheet was produced by melt-kneading a mixture of 75 parts by weight of a polypropylene resin, with 5 parts by weight of a polyethylene resin and 20 parts by weight of calcium carbonate particles having an average size of 1.5 μm in a melt-extruder at a temperature of 270° C., extruding the melt from the extruder, and biaxially drawing the resultant undrawn sheet (M4) at a draw ratio of 5.0 in the longitudinal direction and at a draw ratio of 5.0 in the transverse direction. The resultant single-layered substrate sheet having a thickness of 220 μm was employed in place of the three layered substrate sheet.

The test results are shown in Table 2.

Comparative Example 5

A thermal transfer dye image-receiving sheet was produced and tested by the same procedures as in Example 5, with the following exceptions.

① Preparation of monoaxially oriented sheet (M5) for core layer

The same procedures as in Example 5 were carried out except that the width of the extruding slit of the melt-extruder was changed.

② Preparation of three layered oriented substrate sheet

The same laminating procedures as in Example 5 were carried out except that the extruded undrawn sheets (S4) and (B4), which respectively have the same compositions as (S1) and (B1) of Example 5, were laminated on the front and back surfaces of the monoaxially oriented sheet (M5); and the resultant three layered sheet was drawn at a draw ratio of 7.5 in the transverse direction.

The resultant oriented substrate sheet had total thickness of 1.90 μm and consisted of a monoaxially oriented front surface layer having a thickness of 50 μm, a biaxially oriented core layer having a thickness of 80 μm and a monoaxially oriented back surface layer having a thickness of 60 μm.

The front surface layer had a density of 0.9 g/cm$^3$ and the back surface layer had a density of 1.2 g/cm$^3$.

Also, the resultant oriented substrate sheet exhibited a longitudinal thermal shrinkage of 2.20% and a transverse thermal shrinkage of 0.76% upon heating from 20° C. to 120° C. and a longitudinal tensile modulus of elasticity of 26.7 MPa and a transverse tensile modulus of elasticity of 108.0 MPa at a temperature of 120° C.

③ In the production of thermal transfer dye image-receiving sheet, the same coating liquid (2) as in Example 5 was coated on the front surface of the substrate sheet and dried to form a dye-receiving resin layer having a thickness of 5 μm.

The test results are shown in Table 2.

Comparative Example 6

A thermal transfer dye image-receiving sheet was produced and tested by the same procedures as in Example 5, with the following exceptions.

① Preparation of monoaxially oriented sheet (M6) for core layer

The same procedures as in Example 5 were carried out except that the width of the extruding slit of the melt-extruder was changed.

② Preparation of three-layered oriented substrate sheet

A mixture of 75 parts by weight of a polypropylene resin with 25 parts by weight of calcium carbonate particles having an average size of 1.5 μm was melt-kneaded in a melt-extruder at a temperature of 270° C.; the melt was extruded in a sheet form from the extruder; and the extruded sheet (B5) was laminated on the back surface of the monoaxially oriented sheet (M6). The laminate was drawn at a draw ratio of 3.5 in the transverse direction. Also, a mixture of 95 parts by weight of a polypropylene resin with 5 parts by weight of calcium carbonate particles having an average size of 1.5 μm was melt-kneaded in another melt-extruder at a temperature of 270° C. and extruded into a sheet form from the extruder; and the extruded sheet (S5) was laminated on the front surface of the monoaxially oriented sheet (M6).

The resultant three-layered sheet was drawn at a draw ratio of 3.5 in the transverse direction of the monoaxially oriented sheet (M6).

The resultant oriented substrate sheet had a total thickness of 195 μm and consisted of a monoaxially oriented front surface layer having a thickness of 80 μm, a biaxially oriented core layer having a thickness of 50 μm and a monoaxially oriented back surface layer having a thickness of 65 μm.

The front surface layer had a density of 1.2 g/cm$^3$ and the back surface layer had a density of 1.2 g/cm$^3$.

Also, the resultant oriented substrate sheet exhibited a longitudinal thermal shrinkage of 1.48% and a transverse thermal shrinkage of 0.40% upon heating from 20° C. to 120° C., and a longitudinal tensile modulus of elasticity of 63.7 MPa and a transverse tensile modulus of elasticity of 121.0 MPa at a temperature of 120° C.

③ Production of thermal transfer dye image-receiving sheet

The same coating liquid (2) as in Example 5 was coated on the front surface of the substrate sheet and dried to form a dye-receiving resin layer with a thickness of 5 μm.

The test results are shown in Table 2.

Comparative Example 7

A thermal transfer dye image-receiving sheet was produced and tested by the same procedures as in Example 5, with the following exceptions.

① Preparation of monoaxially oriented sheet (M7) for core layer

The same procedures as in Example 5 were carried out except that the width of the extruding slit of the melt-extruder was changed.

② Preparation of three-layered oriented substrate sheet

A mixture of 70 parts by weight of a polypropylene resin with 10 parts by weight of a polyethylene resin, 10 parts by weight of a polystyrene resin and 10 parts by weight of calcium carbonate particles having an average size of 1.5 μm was melt-kneaded in a melt-extruder at a temperature of 270° C.; the melt was extruded into a sheet form from the extruder; and the extruded sheet (S6) was laminated on a front surface of the monoaxially oriented sheet (M7). Also, a mixture of 50 parts by weight of a polypropylene, 20 parts by weight of a polyethylene resin, 20 parts by weight of a polystyrene and 10 parts by weight of calcium carbonate particles having an average size of 1.5 μm was melt-kneaded in another melt extruder at a temperature of 270° C., and extruded into a sheet form from the extruder; and the resultant extruded sheet (B6) was laminated on the back surface layer of the oriented sheet (M7).

The resultant three-layered sheet was drawn at a draw ratio of 6.0 in the transverse direction.

The resultant oriented substrate sheet had a total thickness of 135 μm and consisted of a monoaxially oriented front surface layer having a thickness of 40 μm, a biaxially oriented core layer having a thickness of 75 μm and a monoaxially oriented back surface layer having a thickness of 20 μm.

The front surface layer had a density of 1.1 g/cm$^3$ and the back surface layer had a density of 0.9 g/cm$^3$.

Also, the resultant oriented substrate sheet exhibited a longitudinal thermal shrinkage of 1.68% and a transverse thermal shrinkage of 0.72% upon heating from 20° C. to 120° C., and a longitudinal tensile modulus of elasticity of 58.6 MPa and a transversal tensile modulus of elasticity of 67.5 MPa at a temperature of 120° C.

③ Production of thermal transfer dye image-receiving sheet

The same coating liquid (2) as in Example 5 was coated on the front surface of the substrate sheet and dried to form a dye-receiving resin layer with a thickness of 5 μm.

The test results are shown in Table 2.

TABLE 2

| | | Substrate sheet | | | | | | | | | | | |
|---|---|---|---|---|---|---|---|---|---|---|---|---|---|
| | | Thickness (μm) | | | Density (g/cm³) | | | | | | | Traveling | Clear- |
| | | Front surface | Back surface | | Front surface | Back surface | Thermal shrinkage (%) | | Tensile modulus of elasticity (MPa) | | Curling | property in | ness of dye |
| Example No. | | layer | layer | Total | layer | layer | Longitudinal | Transverse | Longitudinal | Transverse | (mm) | printer | images |
| Example | 5 | 60 | 50 | 150 | 0.9 | 1.2 | 0.94 | 0.12 | 19.6 | 68.5 | 14 | 2 | 3 |
| | 6 | 100 | 70 | 250 | 1.0 | 1.1 | 1.12 | 0.35 | 24.8 | 82.1 | 18 | 2 | 3 |
| | 7 | 30 | 20 | 80 | 0.9 | 1.0 | 1.32 | 0.46 | 11.3 | 85.9 | 17 | 2 | 3 |
| Comparative | 4 | — | — | 220 | (1.1) | | 2.66 | 1.02 | 57.1 | 87.4 | (*)129 | 1 | 2 |
| Example | 5 | 50 | 60 | 190 | 0.9 | 1.2 | 2.20 | 0.76 | 26.7 | 108.0 | 35 | 1 | 2 |
| | 6 | 80 | 65 | 195 | 1.2 | 1.2 | 1.48 | 0.40 | 63.7 | 121.0 | 38 | 1 | 2 |
| | 7 | 40 | 20 | 135 | 1.1 | 0.9 | 1.68 | 0.72 | 58.6 | 67.5 | (*)115 | 1 | 2 |

Note: (*)1 . . . The sheet curled into a cyldiner form having a diameter shown in the table.

Table 2 clearly shows that the thermal transfer dye image-receiving sheets of Examples 5 to 7 in accordance with the present invention exhibited a high resistance to curling, a good travelling property in the printer and could record thereon clear dye images.

However, the comparative image-receiving sheets of Comparative Examples 4 to 7 significantly curled and often blocked the printer during the thermal transfer printing procedure.

We claim:

1. A thermal transfer dye image-receiving sheet comprising:

a substrate sheet consisting of an oriented thermoplastic film comprising, as principal components, a polyolefin resin and inorganic particles, and a dye-receiving resin layer formed on a surface of the substrate sheet and comprising a resin capable of receiving a thermally transferable dye for forming dye images, the substrate sheet exhibiting thermal shrinkages of 1.50% or less in the longitudinal direction and 0.50% or less in the transverse direction of the substrate sheet when heated from a temperature of 20° C. to a temperature of 120° C., and having tensile moduli of elasticity of 50.0 MPa or less in the longitudinal direction and 100.0 MPa or less in the transverse direction of the substrate sheet, determined at a temperature of 120° C.

2. The thermal transfer dye image-receiving sheet as claimed in claim 1, wherein the polyolefin resin comprises at least one member selected from the group consisting of homopolymers of ethylene, propylene and butene-1 and copolymers of at least two of ethylene, propylene and butene-1.

3. The thermal transfer dye image-receiving sheet as claimed in claim 1, wherein the inorganic particles comprise at least one member selected from the group consisting of calcium carbonate, calcined clay, diatomaceous earth, talc, titanium dioxide, barium sulfate, aluminum sulfate and silica.

4. The thermal transfer dye image-receiving sheet as claimed in claim 1, wherein the inorganic particles are present in an amount of 3 to 80% based on the total weight of the drawn thermoplastic film.

5. The thermal transfer dye image-receiving sheet as claimed in claim 1, wherein the oriented thermoplastic film further comprises an additional thermoplastic resin different from the polyolefin resin and in an amount of 0.5 to 50% based on the weight of the polyolefin resin.

6. The thermal transfer dye image-receiving sheet as claimed in claim 1, wherein the substrate sheet has a thickness of 80 to 300 μm.

7. The thermal transfer dye image-receiving sheet as claimed in claim 1, wherein the dye-receiving resin for the dye-receiving resin layer comprises at least one member selected from the group consisting of saturated polyester resins, vinyl chloride-vinyl acetate copolymer resins, vinyl chloride-vinyl propionate copolymer resins, polycarbonate resins, polyvinyl acetal resins, polyacrylic acid ester resins, cellulose derivatives, and actinic radiation-cured resins.

8. The thermal transfer dye image-receiving sheet as claimed in claim 1, wherein the dye-receiving resin layer has a thickness of 1 to 12 μm.

9. The thermal transfer dye image-receiving sheet as claimed in claim 1, wherein the dye-receiving resin layer comprises, in addition to the dye-receiving resin, a pigment in amount of 5 to 20% based on the weight of the dye-receiving resin.

10. The thermal transfer dye image-receiving sheet as claimed in claim 9, wherein the pigment for the dye-receiving resin layer comprises fine silica particles having a particle size of 1 to 12 μm and a specific surface area of 30 to 250 $m^2/g$.

11. The thermal transfer dye image-receiving sheet as claimed in claim 1, wherein the oriented thermoplastic film is provided with a multi-layered structure comprising a front surface layer on which the dye-receiving resin layer is formed, a back surface layer and at least one core layer located between the front and back surface layers; and satisfying the requirements (1) and (2):

$$Ds<Db \quad (1)$$

$$Ws>Wb \quad (2)$$

wherein Ds represents a density of the front surface layer, Db represents a density of the back surface layer, Ws represents a thickness of the front surface layer and Wb represents a thickness of the back surface layer; and has a total thickness of 50 to 300 μm.

12. The thermal transfer dye image-receiving sheet as claimed in claim 11, wherein in the requirement (1), the densities Ds and Db are 0.5 to 1.2 g/cm$^3$ and 0.8 to 1.5 g/cm$^3$, respectively, and a ratio of Ds to Db is in the range from 0.3 to 0.95.

13. The thermal transfer dye image-receiving sheet as claimed in claim 11, wherein in the requirement (2), the thicknesses Ws and Wb are 20 to 120 μm and 15 to 100 μm, respectively.

14. The thermal transfer dye image-receiving sheet as claimed in claim 11, wherein the core layer of the substrate sheet has a thickness of 15 to 80 μm.

15. The thermal transfer dye image-receiving sheet as claimed in claim 11, wherein in the oriented thermoplastic film, the front surface layer comprises a polyolefin resin film containing 0 to 25% by weight of inorganic particles, the core layer comprises a polyolefin resin film containing inorganic particles in an amount more than that in the polyolefin resin film for the front surface layer and having a plurality of microvoids formed by drawing, and the back surface layer comprises a polyolefin resin film containing 10 to 75% by weight of inorganic particles.

16. The thermal transfer dye image-receiving sheet as claimed in claim 11, wherein each of the front surface, core and back surface layers comprises independently from each other, a polyolefin resin selected from the group consisting of polyethylene resins, polypropylene resins, ethylene-propylene copolymer resins, ethylene-vinyl acetate copolymer resins and poly(4-methylpentene-1) resins.

17. The thermal transfer dye image-receiving sheet as claimed in claim 11, wherein the oriented thermoplastic film for the substrate sheet has been produced by coating a polyolefin resin melt on a surface of a core polyolefin resin film drawn in one direction and further coating a polyolefin resin melt on the opposite surface of the core polyolefin resin film, by a melt-laminating method; cooling the resultant three-layered film to room temperature; heating the cooled film at a temperature of 100° to 180° C.; drawing the heated film in a direction at a right angle to the drawing direction of the core polyolefin resin film; and heat treating the drawn film at a temperature of 50° to 120° C.

18. The thermal transfer dye image-receiving sheet as claimed in claim 17, wherein in the three-layered film, the core layer has a plurality of microvoids and the front and bottom surface layers have roughened outside surfaces having a Bekk smoothness of 500 to 15000 seconds.

* * * * *